United States Patent [19]

Marino

[11] 4,075,531

[45] Feb. 21, 1978

[54] BASE-SOCKET SYSTEM WITH ARC PREVENTION MEANS

[75] Inventor: Armando V. Marino, Chicago, Ill.

[73] Assignee: Zenith Radio Corporation, Glenview, Ill.

[21] Appl. No.: 756,204

[22] Filed: Jan. 3, 1977

[51] Int. Cl.[2] ..... H01J 17/00

[52] U.S. Cl. ..... 313/325; 339/111; 313/318

[58] Field of Search ..... 313/325, 318; 339/145 T, 111, 194 R, 194 N

[56] References Cited

U.S. PATENT DOCUMENTS

| | | | |
|---|---|---|---|
| 3,278,886 | 11/1966 | Blumenberg et al. | 339/145 T |
| 3,867,671 | 2/1975 | Johnson | 339/111 |
| 3,869,633 | 3/1975 | Dumas | 313/318 |
| 3,995,194 | 11/1976 | Blacker et al. | 315/382 |

*Primary Examiner*—Alfred E. Smith
*Assistant Examiner*—David K. Moore
*Attorney, Agent, or Firm*—John H. Coult

[57] ABSTRACT

An axially compact and highly arc protective base-socket system for use with a color television picture tube having a narrow neck terminated by a cylindrical coaxial tubulation. The tubulation is surrounded by a number of axially extending electrically conductive low-voltage pins and at least one high voltage pin. The base-socket system comprises a base and a socket. The base fits over and is secured to the tubulation and passes the pins extending from the neck of the tube. The base comprises: a plurality of axially and radially outwardly extending insulating walls, the low voltage pins lying between the walls; means defining an axially extending deep narrow cavity which receives the high voltage pin, the cavity having a depth at least twice as great as the largest transverse dimension thereof; and a cavity lip surrounding the mouth of the cavity. The socket comprises: an annular support means defining a series of axially and radially inwardly extending channels for mating with the insulating walls on the base to unambiguously orient the base relative to the socket; a series of contacts on the annular support means for establishing electrical connection with the plurality of low-voltage pins on the base when the base is inserted into the socket; an axially extending socket protrusion for mating with the axially extending deep narrow cavity; a high voltage contact in the socket protrusion for establishing electrical connection with the high voltage pin on the base when the base is inserted into the socket; a cap having an annular arc-path-length-extending flange which externally telescopes over the cavity lip. When the base and socket are connected the mating of the socket protrusion and flange with the base cavity and lip form multiply folded extended arc path lengths providing a very high degree of arc prevention in an axially compact system.

2 Claims, 4 Drawing Figures

BASE-SOCKET SYSTEM WITH ARC PREVENTION MEANS

BACKGROUND OF THE INVENTION

This invention relates to a color television picture tube base-socket system for connecting a color television picture tube to a television chassis. Typically, a cathode ray tube used as a picture tube in a television receiver has a plurality of pins extending from a base for plugging into a socket which is connected to the chassis. The base is attached to the end of a neck of the color television picture tube. The pins are generally arranged in a ring and a voltage in the range of a few hundred volts or less is applied to most of the pins. A single pin may be present which has up to about 7500 volts.

In order to prevent damage to the cathode ray tube caused by excessive voltage on the pins, color cathode ray tube sockets are normally provided with some type of safety device in the form of a grounding apparatus. Usually the grounding apparatus permits a spark to jump from a pin contact to ground in the event that the pin contact is receiving an excessive potential. This prevents damage to the tube due to excess potential at one of the pin contacts by providing a nondestructive shunt path for the arc.

It is possible, however, that arcs may occur from a high voltage pin on the base to one or more low voltage pins on the base even when the socket is provided with a grounding apparatus. Conventionally, insulative barriers or walls are molded as part of the base structure so that the pins are separated electrically and physically from one another. The limit to which potentials may increase on the pins before an arc occurs between the pins is dependent on the size and shape of the walls. The farther in distance an arc must travel between pins (the arc path length), the better the arc prevention provided by the base.

This invention has many applications, but is believed to be most advantageously associated with a tube having a unique electron gun as disclosed in U.S. Pat. No. 3,995,194, assigned to the same assignee as the present application. This gun has a main focus lens with three or more electrodes, which receive, in a preferred embodiment, operating potentials of about 30 kV, about 12 kV and about 7.5 kV. The 30 kV electrode receives its operating potential through an electrode which is introduced by means of an anode button, as is conventional. However, the relatively high 12 kV potential, the video signal, and other low potentials, and the relatively intermediate 7.5 kV focus voltage are preferably brought through the base of the tube.

It is desirable that a base-socket system be resistive to arcing when voltage potentials in excess of 12 kV are applied to the pins. These extremely high voltage potentials appear, for example, when a tube arcs during operation due to the presence of impurities inside the tube or when the tube is processed (e.g. spot knocking); potentials as high as 30 kV may occur on the pins. This invention provides a novel base-sockt system which is capable of preventing arcs when excessively high voltages appear on the pins of the tube.

It is well known in the art to extend the arc path by providing axially extending walls around a high voltage pin. If an arc does occur the arc must travel from the high voltage pin over the wall and to the next adjacent pin. U.S. Pat. No. 3,278,886 issued to H. H. Blumenberg et al. discloses a nonconductive shielding wall surrounding a high voltage pin for arc prevention. It is believed that it would be difficult, if not impossible, using the shielding wall disclosed in the Blumenberg patent to provide adequate arc prevention when the operating potential on the pin is as high as 10 to 15 kV. It is certain that the shielding wall would not prevent arcs from occurring when much greater potentials in the range of plural tens of kilovolts might appear on the high voltage pin. These high potentials may appear when a tube arcs during operation or when the tube is being processed (for example, during spot knocking). If the shielding wall were extended in length a distance adequate to provide full arc prevention, the resulting structure would be commercially impractical due to the exended length of the picture tube, and also it is doubtful that such a socket could be molded with present molding techniques.

OBJECTS OF THE INVENTION

It is a general object of the present invention to provide a base-socket system for connecting a color television picture tube to a television chassis, which is capable of preventing arcs during the presence of abnormally high voltages on the pins of the tube.

It is a more specific object of the present invention to provide for a color television receiver picture tube in axially compact and highly arc protective base-socket system wherein one or more of the base pins on the tube carry a relatively low operating potential in a range of several hundred volts or less, and at least one other pin which carries a relatively high operating potential.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
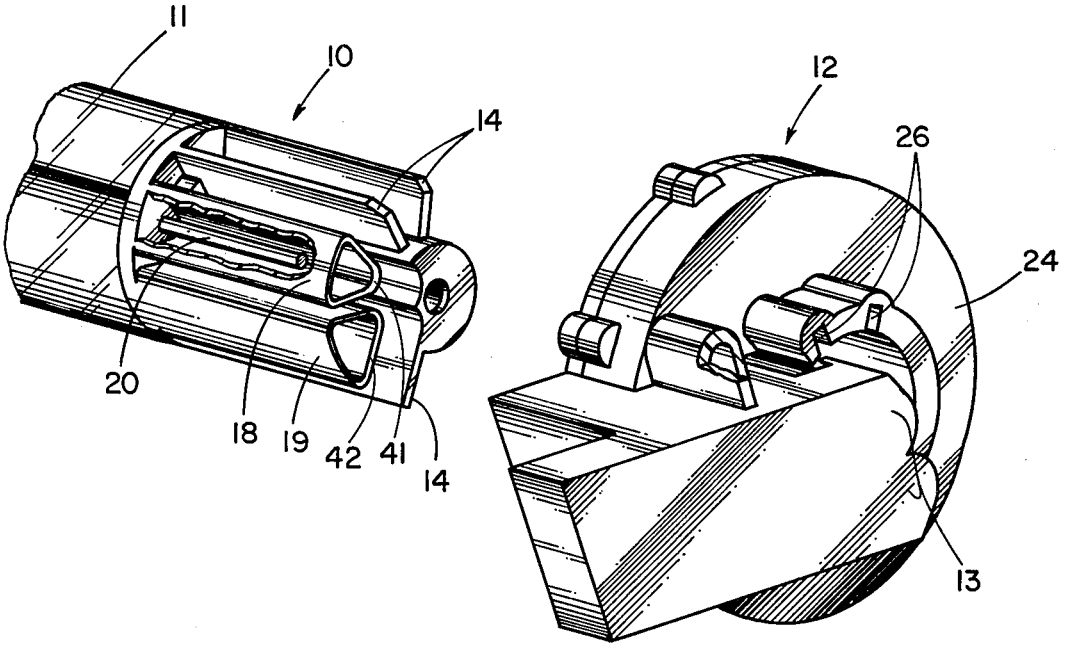
FIGS 1 and 2 are perspective views from opposite sides of a base-socket according to this invention.
Figure 2:
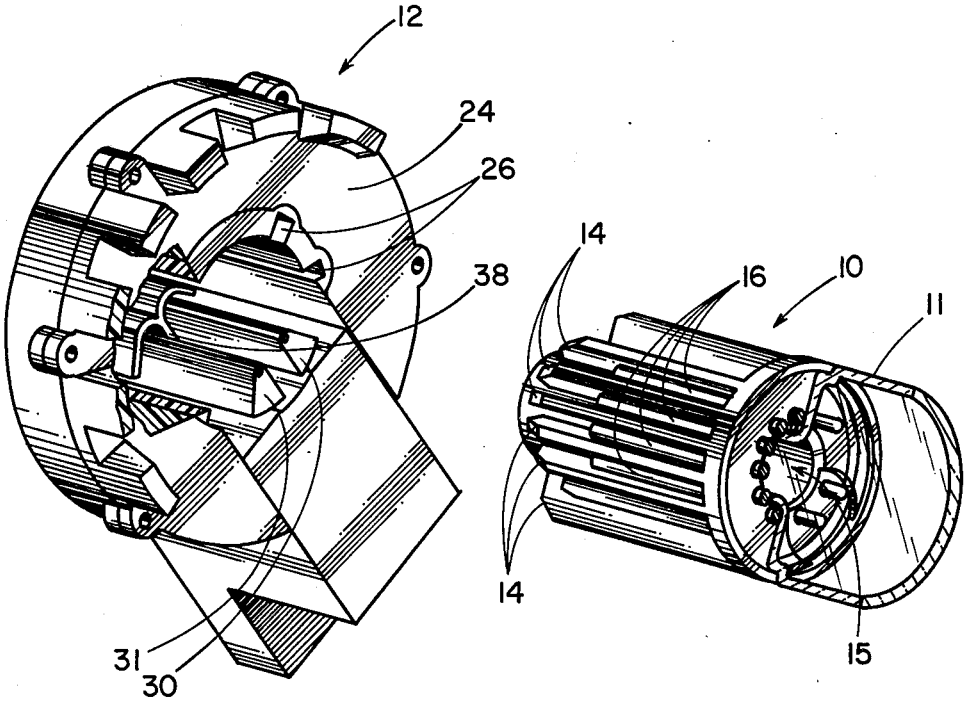

This invention relates to a novel base-socket system for connecting a color television picture tube to a television chassis. The color television picture tube to which this invention is applied incudes a faceplate and a mating funnel. The funnel has a neck in which is located an electron gun assembly and other interior elements of the picture tube which are connected to a number of pins located on a base which is attached to the end of the neck.

A unique electron gun is disclosed in U.S. Pat. No. 3,995,194. As described, this gun has a lens electrode which requires, in addition to an anode voltage, a second relatively high operating potential (e.g., approximately 12,000 volts) in addition to a focus electrode potential (e.g., of approximately 7500 volts), which is intermediate to the second high voltage and the potential voltages received by the gun's low voltage elements. By this invention a novel base-socket system is provided which is capable of having potentials much higher than the 12,000 volts carried by the second high voltage pin without arcs occurring between the pins on the base. The present invention is also applicable to conventional color television picture tubes having a base with a single high voltage pin and one or more low-voltage pins.

The present invention will now be described. The present invention is an axially compact and highly arc protective base-socket system for use with a color television picture tube having a narrow neck terminated by a cylindrical coaxial tubulation. The tubulation is surrounded by a number of axially extending electrically conductive low-voltage pins and at least one high voltage pin. The base-socket system comprises a base and a socket. The base fits over and is secured to the tubulation and passes the pins extending from the neck of the tube. The base comprises: a plurality of axially and radially outwardly extending insulating walls, the low voltage pins lying between the walls; means defining an axially extending deep narrow cavity which receives the high voltage pin, the cavity having a depth at least twice as great as the largest transverse dimension thereof; and a cavity lip surrounding a mouth of the cavity. The socket comprises: an annular support means defining a series of axially and radially inwardly extending channels for mating with the insulating walls on the base to unaambiguously orient the base relative to the socket; a series of contacts on the annular support means for establishing electrical connection with the plurality of low-voltage pins on the base when the base is inserted into the socket; an axially extending socket protrusion for mating with the axially extending deep narrow cavity; a high voltage contact in the socket protrusion for establishing electrical connection with the high voltage pin on the base when the base is inserted into the socket; a cap having an annular arc-path-length-extending flange which externally telescopes over the cavity lip. When the base and socket are connected the mating of the socket protrusion and flange with the base cavity and lip form multiply folded extended arc path lengths providing a very high degree of arc prevention in an axially compact system.

FIGS. 1–4 of the drawings show a base 10 and socket 12 embodying the present invention. The base 10 fits over and is secured to a cylindrical tubulation 15 extending coaxially from a narrow color television picture tube neck 11. The base 10 passes pins 16, 18 and 19 which surround the tubulation 15 on the tube neck 11. The base 10 has a plurality of axially and radially outwardly extending insulating walls 14. Lying within the walls 14 are electrically conductive low voltage pins 16. The pins 16 are electrically connected to low voltage elements of the electron gun (not shown) in the color television picture tube. In addition to the walls 14, the base has first and second axially extending deep narrow cavities 18, 19. In the preferred embodiments these cavities 18, 19 are in the form of tubes. For reasons which will become clear hereinafter, the cavities preferably each have a depth which is at least twice as great as its largest transverse dimension thereof. The cavities 18, 19 are adjacent but electrically and physically isolated from one another. First and second cavity lips 41, 42 surround the mouths of the first amd second cavities 18, 19, respectively.

An axially extending, electrically conductive high voltage pin 20 extends into the first cavity 18 through a bottom wall thereof. The high voltage pin 20 is electrically connected to a high voltage element (not shown) of the electron gun in the color television picture tube. (The high voltage picture pin is in reference to the other pins on the base and is not to be confused with the 30 kV potential used for the screen voltage.) Likewise, an axially extending electrically conductive mid-voltage pin 22 extends into the second cavity 19 through a bottom wall thereof. The mid-voltage pin is electrically connected to a mid-voltage element (not shown) of the electron gun in the color television picture tube.

The socket 12 has an annular support means 24 defining a series of axially and radially inwardly exending channels 26 for mating with the insulating walls 14 on the base 10. These channels 26 unambiguously orient the base 10 relative to the socket 12. A series of contacts (not shown) on the support means 24 establish electrical connection with the plurality of pins 16 on the base 10 when the base 10 is inserted into the socket 12. First and second axially extending socket protrusions 30, 31 for mating with the first and second axially extending deep narrow, cavities 18, 19, respectively, are provided on the socket 12. First and second contacts 32 and 34 are provided in the first and second socket protrusions 30 and 31, respectively, for establishing electrical connection with the high voltage pin 20 and the mid-voltage pin 22, respectively. The electrical connection is established when the base 10 is inserted into the socket 12. The socket 12 also has a cap 13 which has an annular arc-path-length-extending flange 38 which externally telescopes over said first and second cavity lips 41, 42. When the base 10 and socket 12 are assembled, the mating of the socket protrusions 30, 31 and flange 38 with the base cavities 18, 19 and lips 41, 42 form multiply folded extended arc path lengths providing a very high degree of arc protection in an axially compact system.

Figure 3:
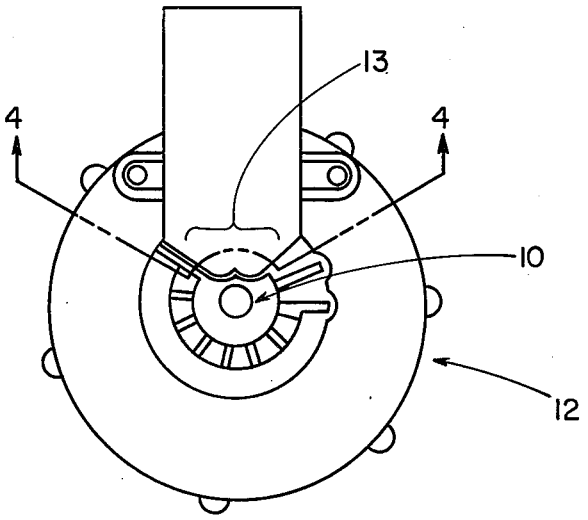
FIG. 3 is an end view of the assembled base and socket.
Figure 4:
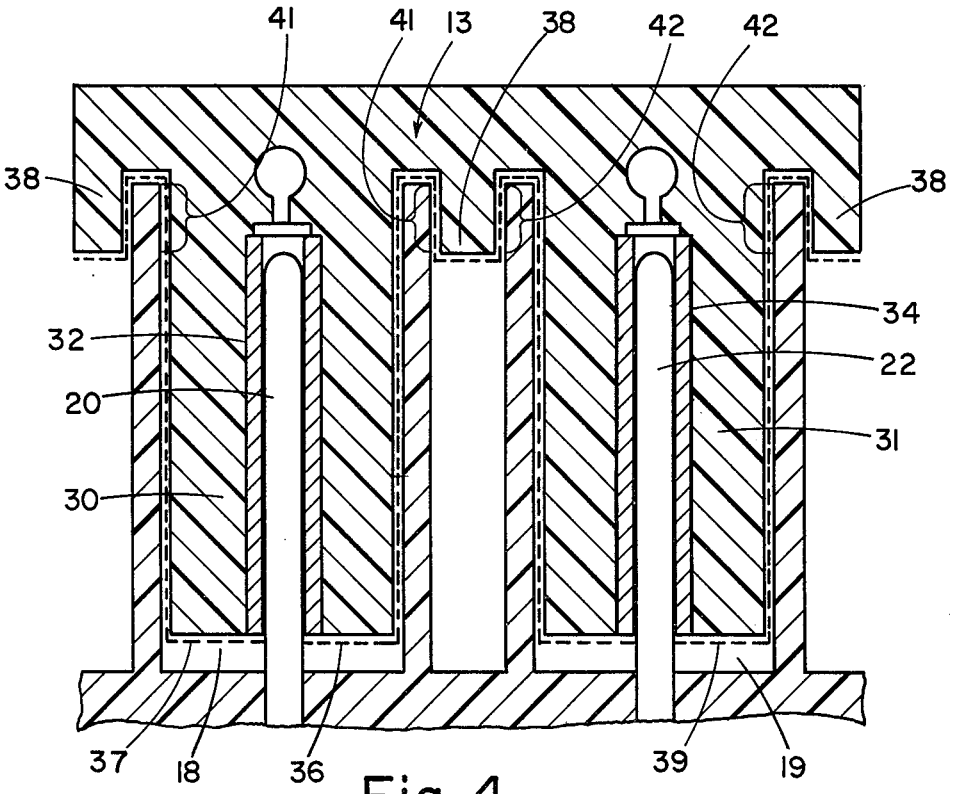
FIG. 4 is a fragmentary radial cross-sectional view of the FIGS. 1–3 base-socket system, taken along lines 4—4 in FIG. 3.

FIG. 3 is an end view of the assembled base 10 and socket 12 and FIG. 4 is a radial cross-section view taken across cavities 18, 19. FIG. 4 shows the novel structure of this invention which provides a multiply folded extended arc path length length (illustrated as a broken line 36). The potential difference which may exist without arcing between the high voltage pin 20 and mid-voltage pin 22 is dependent upon the effective arc path length between the pins. The insulative material of which the base 10 and socket 12 is constructed is sufficient to resist any arcs. However, no matter how close a fit exists between the assembled base 10 and socket 12 an air gap will always be present, and it is through this air gap that an arc will travel when the potential difference between the high voltage pin 20 and the mid-voltage pin 22 is great enough. Therefore it is desirable to make this arc path length 36 as long as possible within the space available.

As illustrated in FIG. 4, in the novel base-socket system of the present invention an arc must travel from the bottom of the cavity 18 to the top of that cavity, over the cavity lip 41, under flange 38, over cavity lip 42 and then down to the bottom of the cavity 19. In the preferred embodiment an arc path length of approximately two inches is provided between the high voltage pin 20 and the mid-voltage pin 22. A distance this great for an arc path length was never before thought possible within the constraints of size which is dictated by the base and socket for a color television picture tube. It has been demonstrated that the illustrated preferred embodiment of the present invention can withstand a potential difference between the high voltage pin 20 and the mid-voltage pin 22 of tens of kilovolts.

The preferred embodiment of the present invention also provides extended arc path lengths from the high voltage pin 20 to one or more of the low voltage pins 16 (see arc path length 37 in FIG. 4) and also from the mid-voltage pin 22 to one or more of the low voltage pins 16 (see arc path length 39 in FIG. 4). Here the arc path length extends from the bottom of one of the cavities 18 or 19 to the top of that cavity, over the cavity lip 41 or 42, under the flange 38 and then around one of the walls 14 on the base until it reaches one of the pins 16. Thus this novel base-socket system provides a very high degree of arc prevention in an axially compact system for color television picture tubes having a relatively high voltage pin normally receiving a potential in the range of about 10 kV to 15 kV, one or more relatively low voltage pins normally receiving a potential of no more than a few hundred volts, and a mid-voltage pin normally receiving a relatively intermediate potential range.

The invention is not limited to the particular details of the method depicted and other modifications and applications are contemplated. Certain changes may be made in the above-described method without departing from the true spirit and scope of the invention herein involved. It is intended therefore that the subject matter in the above depiction shall be interpreted as illustrative and not in a limiting sense.

What is claimed is:

1. An axially compact and highly arc protective base-socket system for use with a color television picture tube having a narrow neck terminated by a cylindrical coaxial tubulation surrounded by a number of axially extending, electrically conductive low voltage pins and at least one high voltage pin, said base-socket system comprising:

a base fitting over and secured to said tubulation and passing said pins extending from said neck of said tube, said base comprising:

a plurality of axially and radially outwardly extending insulating walls, said low voltage pins lying between said walls, means defining an axially extending deep narrow cavity which receives said high voltage pin, said cavity having a depth at least twice as great as the largest transverse dimension thereof, and a cavity lip surrounding a mouth of said cavity;

a socket comprising:

an annular support means defining a series of axially and radially inwardly extending channels for mating with said insulating walls on said base to unambiguously orient said base relative to said socket, a series of contacts on said annular support means for establishing electrical connection with said plurality of low voltage pins on said base when said base is inserted into said socket, an axially extending socket protrusion for mating with said axially extending deep narrow cavity, a high voltage contact in said socket protrusion for establishing electrical connection with said high voltage pin on said base when said base is inserted into said socket, a cap having an annular arc-path-length-extending flange which externally telescopes over said cavity lip, whereby when said base and socket are connected, the mating of said socket protrusion and flange with said base cavity and lip form multiply folded extended arc path lengths providing a very high degree of arc protection in an axially compact system.

2. An axially compact and highly arc protective base-socket system for use with a color television picture tube having a narrow neck terminated by a cylindrical coaxial tubulation surrounded by a number of axially extending, electrically conductive low voltage pins for receiving a potential of no more than a few hundred volts, a high voltage pin for receiving a potential in the range of about 10 kV to 15 kV and a mid-voltage pin for receiving a potential in a relatively intermediate potential range, said base-socket system comprising:

a base fitting over and secured to said tubulation and passing said pins extending from said neck of said tube, said base comprising;

a plurality of axially and radially outwardly extending insulating walls, said low voltage pins lying between said walls, means defining first and second axially extending deep narrow cavities which receive said high voltage pin and said mid-voltage pin, respectively, said cavities each having a depth at least twice as great as the largest transverse dimension thereof, said cavities being adjacent but electrically and physically isolated from one another, first and second cavity lips surrounding mouths of said first and second cavities, respectively;

a socket comprising:

an annular support means defining a series of axially and radially inwardly extending channels for mating with said insulating wall on said base to unambiguously orient said base relative to said socket, a series of contacts on said annular support means for establishing electrical connection with said plurality of low voltage pins on said base when said base is inserted into said socket, first and second axially extending socket protrusions for mating with said first and second axially extending deep narrow cavities, respectively, a high voltage contact in said first socket protrusion and a mid-voltage contact in said second socket protrusion for establishing electrical connection with said high voltage pin and said mid-voltage pin, respectively, on said base when said base is inserted into said socket, a cap having an annular arc-path-length-extending flange which externally telescopes over said first and second cavity lips, whereby when said base and socket are connected, the mating of said socket protrusions and flange with said base cavities and lips form multiply folded extended arc path lengths providing a very high degree of arc protection in an axially compact system.

* * * * *